United States Patent [19]

Sawayama et al.

[11] 4,453,493

[45] Jun. 12, 1984

[54] TONER RECIRCULATING AND AGITATING DEVICE FOR DRY PROCESS DEVELOPING APPARATUS

[75] Inventors: Noboru Sawayama, Yokohama; Masumi Ikesue, Tokyo, both of Japan

[73] Assignee: Ricoh Company, Ltd., Tokyo, Japan

[21] Appl. No.: 477,560

[22] Filed: Mar. 21, 1983

[30] Foreign Application Priority Data

Apr. 19, 1982 [JP] Japan ..... 57-64915

[51] Int. Cl.[3] ..... G03G 15/09

[52] U.S. Cl. ..... 118/658; 118/602; 118/608; 118/612

[58] Field of Search ..... 118/658, 602, 608, 612

[56] References Cited

U.S. PATENT DOCUMENTS 4,226,524 10/1980 Hashimoto ..... 118/658 X

*Primary Examiner*—Bernard D. Pianalto

*Attorney, Agent, or Firm*—David G. Alexander

[57] ABSTRACT

In a dry process developing apparatus, a toner recirculating and agitating device includes a regulator member located between a magnet brush forming member and a doctor blade to face the periphery of a developing sleeve at a predetermined spacing therefrom. This spacing is progressively reduced toward the doctor blade to increase the force which tends to recirculate the toner through a predetermined path.

5 Claims, 5 Drawing Figures

TONER RECIRCULATING AND AGITATING DEVICE FOR DRY PROCESS DEVELOPING APPARATUS

BACKGROUND OF THE INVENTION

The present invention relates to a dry process developing apparatus for use in an image recording system which includes a drum-shaped latent image support member, e.g. an electrophotographic copying machine or a facsimile apparatus. More particularly, the present invention relates to a toner recirculating and agitating device installed in such a developing apparatus.

A prior art dry process developing apparatus of the type described includes a developing roller for forming a magnet brush of a toner thereon and made up of stationary magnets and a developing sleeve rotatable around the magnets, a toner supply roller for supplying the toner to the developing roller, a housing for covering the rollers, and a toner recirculating and agitating device adapted to recirculate the toner to an even distribution within the housing.

Where use is made of a known two-component developer in particular, the toner recirculating and agitating device may include a first toner guide plate formed integrally with a doctor blade which regulates the thickness of a toner layer on the developing sleeve, and a second toner guide plate located below and at a spacing from the first toner guide plate to face the latter. The first and second toner guide plates define a toner recirculation path therebetween. The end of the toner guide plate is spaced from the adjacent wall of the doctor blade to define an inlet of the toner recirculation path through which part of the toner scraped off by the doctor blade is returned to the toner supply roller along the second toner guide plate. A second toner recirculation path is defined by an opening formed through an intermediate portion of the second toner guide plate, a screw conveyor positioned just below the opening and surrounded by a casing, and an opening formed through the bottom of the casing.

In the thus constructed developing apparatus, it is a primary requisite that the toner be fully agitated in order to eliminate any uneven distribution of the toner and, thereby, maintain a constant level of developing ability. This in turn requires the toner removed by the doctor blade to be successively fed towards the second toner guide plate and continuously flow therealong. To agitate the toner more efficiently, it is preferable that the toner on the second toner guide plate be dropped therefrom onto the toner supply roller over as large a height as possible. For this purpose, the recirculation path has to be positioned higher than the scraping end of the doctor blade.

The force tending to recirculate the toner results from the rotation of the developing sleeve and its magnitude depends on the force of the magnets, permeability of the toner, frictional resistance between the toner and the developing sleeve, and angle of friction of the toner itself. Should these parameters be excessively large, a substantial energy would be consumed for the drive of the developing apparatus. This is contradictory to the increasing demand for energy saving while speeding up the fatigue of the toner. Meanwhile, should the toner recirculating force be weak, the flow of the toner would become stopped on the second toner guide plate preventing the toner from being sufficiently agitated.

An attempt has been made to overcome the problem discussed above by shifting the doctor blade to as low a position as possible to incline its wall relative to the vertical plane, so that the resistance to the flow of the toner due to gravity may be suppressed. However, this is not a satisfactory solution to the problem concerned. The low position of the doctor blade requires the recirculation path to be also defined at a low level, which cannot cause the toner to drop over a substantial height onto the toner reservoir. This limits the available toner agitating ability. Also, in the resulting low position of the toner recirculating and agitating device, the screw conveyor and the like are apt to interfere with the toner supply roller.

SUMMARY OF THE INVENTION

It is an object of the present invention to provide a toner recirculating and agitating device for a dry process developing apparatus which recirculates a toner most efficiently for a relatively small magnitude of toner recirculating force.

It is another object of the present invention to provide a toner recirculating and agitating device for a dry process developing apparatus which effectively agitates the toner by increasing the toner recirculating force.

It is another object of the present invention to provide a toner recirculating and agitating device for a dry process developing apparatus which forces the toner to a substantial height to drop it through a substantial level difference.

It is another object of the present invention to provide a generally improved toner recirculating and agitating device for a dry process developing apparatus.

In a developing apparatus including a member for forming a magnet brush of a toner and a toner supply member for supplying the toner to the magnet brush forming member, a toner recirculating and agitating device embodying the present invention includes a blade member for controlling the magnet brush on the magnet brush forming member to a predetermined thickness. Means is provided for guiding the toner scraped by the blade member off the magnet brush forming member from the blade member to the toner supply member. Means is also provided for intensifying a force which recirculates the toner which is directed toward the guide means.

In accordance with the present invention, in a dry process developing apparatus, a toner recirculating and agitating device includes a regulator member located between a magnet brush forming member and a doctor blade to face the periphery of a developing sleeve at a predetermined spacing therefrom. This spacing is progressively reduced toward the doctor blade to increase the force which tends to recirculate the toner through a predetermined path.

The above and other objects, features and advantages of the present invention will become apparent from the following detailed description taken with the accompanying drawings.

DESCRIPTION OF THE PREFERRED EMBODIMENTS

While the toner recirculating and agitating device for a dry process developing apparatus of the present invention is susceptible of numerous physical embodiments, depending upon the environment and requirements of use, a substantial number of the herein shown and described embodiment have been made, tested and used, and all have performed in an eminently satisfactory manner.

Figure 1:
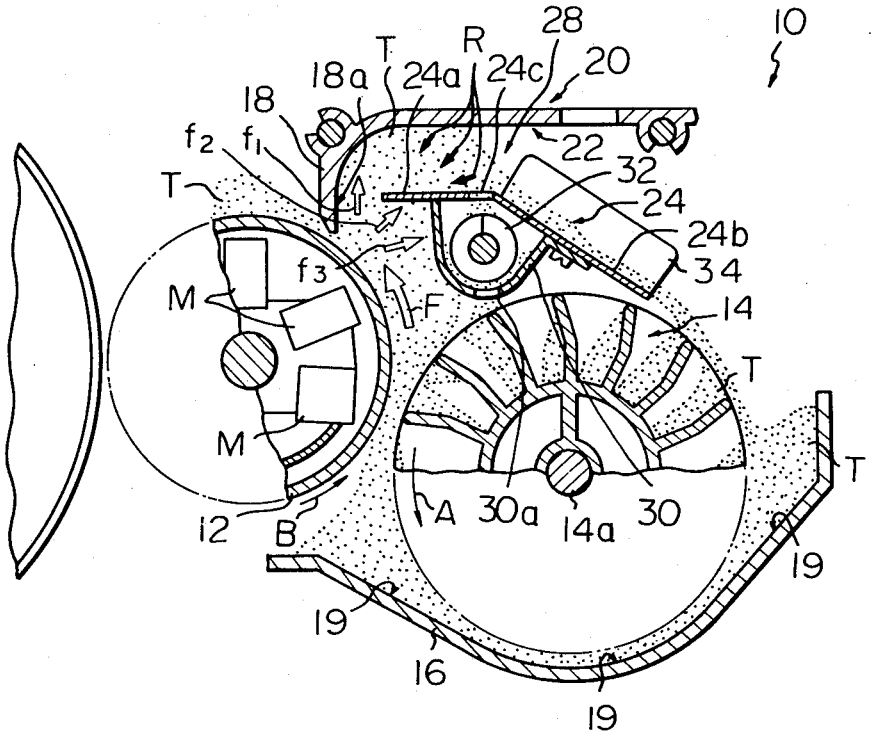
Fig. 1 PRIOR ART
FIG. 1 is a schematic view of a prior art toner recirculating and agitating device installed in a dry process developing apparatus of an image recording system.

To facilitate understanding of the present invention, a brief reference will be made to a prior art device of the kind concerned, illustrated in FIG. 1. A developing apparatus generally designated by the reference numeral 10 includes a developing sleeve 12 rotatable around stationary magnets M, a toner supply roller 14 located to face the sleeve 12 at a horizontally spaced position to supply a toner to the sleeve 12, and a housing 16 in which the sleeve 12 and roller 14 are disposed. A doctor blade 18 is positioned at a spacing from the periphery of the sleeve 12 so as to regulate the thickness of a toner layer formed thereon. The toner recirculating and agitating device 20 is constructed such that the toner T scraped off by the doctor blade 18 is evenly distributed on the roller 14 or in a toner reservoir 19 along the axis of the sleeve 12. The toner reservoir 19 surrounds substantially the lower half of the periphery of the roller 14.

The device 20 comprises a first toner guide plate 22 having a horizontal section and a second toner guide plate 24 which opposes the first toner guide plate 22 at a spacing therefrom. The first toner guide plate 22 is formed integrally with the doctor blade 18. Major part of the toner T removed by the doctor blade 18 is forced toward the device 20 along the adjacent wall 18*a* of the doctor blade 18 as the developing sleeve 12 is rotated. The device 20 then routes the toner therealong to recirculate it toward the toner supply roller 14. The second toner guide plate 24 comprises a horizontal section 24*a* and an inclined section 24*b* which extends rearwardly downwardly from the horizontal section 24*a*. Thus, a toner recirculating path 28 extends from a gap between the wall 18*a* of the doctor blade 18 and the adjacent end of the horizontal section 24*a* to the toner reservoir 19 via the second toner guide plate 24. The toner guide plate 24 is formed with an opening 24*c* ahead of its bent between the first and second sections 24*a* and 24*b* and adjacent to one lateral edge thereof. A screw conveyor 32 is positioned just below the opening 24*c* and covered by a casing 30. The casing 30 is formed with an opening 30*a* adjacent to its one lateral edge which is opposite to the edge of the toner guide plate 24 where the opening 24*c* is located.

The free end of the inclined section 24*b* of the toner guide plate 24 is disposed above the toner supply roller 14. A number of spaced deflector plates 34 are mounted upright on the inclined section 24*b*. As viewed in a plan, the deflector plates 34 in their lengthwise direction are not perpendicular to the axis 14*a* of the roller 14 but inclined thereto at a certain angle. Therefore, the toner T flowing down along the inclined section 24*b* guided by the deflectors 34 will be progressively deflected in accordance with the angle of inclination of the deflectors 34 and in the direction perpendicular to the sheet of FIG. 1. Meanwhile, the toner T moving along the horizontal section 24*a* partly drops onto the screw conveyor 32 through the opening 24*c* and thereby conveyed deeper into the casing 30 in the direction perpendicular to the sheet surface, so that this part of the toner T will drop onto the toner supply roller 14 through the opening 30*a*, which is remote from the opening 24*c*.

In case where use is made of a two-component developer, the toner recirculating and agitating device 20 sets up an even distribution of toner supply to and along the axis of the developing sleeve 12. If an image to be developed consumes an uneven amount of the toner along the axis of the sleeve 12 and undergoes repeated development, for example, the device 20 will eliminate any uneven density distribution or any undepeloped area on the developed image surface due to the short toner supply resulting from the uneven toner distribution in the toner reservoir 19.

During operation of the developing apparatus, the toner supply roller 14 is rotated as indicated by an arrow A to scoop up the toner T from the toner reservoir 19, which surrounds the lower half of the roller 14. The roller 14 supplies the toner to the developing sleeve 12 which is rotated in the direction indicated by an arrow B. The magnets M in the sleeve 12 attract the toner T onto the periphery of the sleeve 12 and cause it to move therewith. The doctor blade 18 removes the toner layer on the sleeve 12 except for a thickness of the toner which is necessary for development. The removed toner T is partly let fall through between the sleeve 12 and the roller 12 and partly forced to advance along the second toner guide plate 24. As already mentioned, part of the toner on the horizontal section 24*a* drops through the opening 24*c* and conveyed by the screw conveyor 32 to drop into the toner reservoir 19, while the rest is guided by the deflectors 34 to recirculate into the toner reservoir 19 as well as onto the roller 12. The toner layer on the sleeve 12 moved passed the doctor blade 18 is partly consumed for development during the course of its movement through a developing station, and the rest remains on the sleeve 12 to be reused for development.

The toner T removed by the doctor blade 18 is subjected to a force F which tends to urge it upwardly to thereby recirculate it. However, the force F is divided into a plurality of components as indicated by $f_1$, $f_2$ and $f_3$, for example, so that only part of the force ($f_1$ in the drawing) is capable of counteracting the resistance R, which originates from the gravity and the magnetic field developed by the magnets M. It is therefore quite difficult to move the toner against the gravity through the recirculation path.

The present invention is successful to eliminate the drawback discussed above and will now be described with reference to FIGS. 2 and 3*a*–3*c*. In these drawings, the same structural elements as those shown in FIG. 1 are designated by the same reference numerals.

Figure 2:
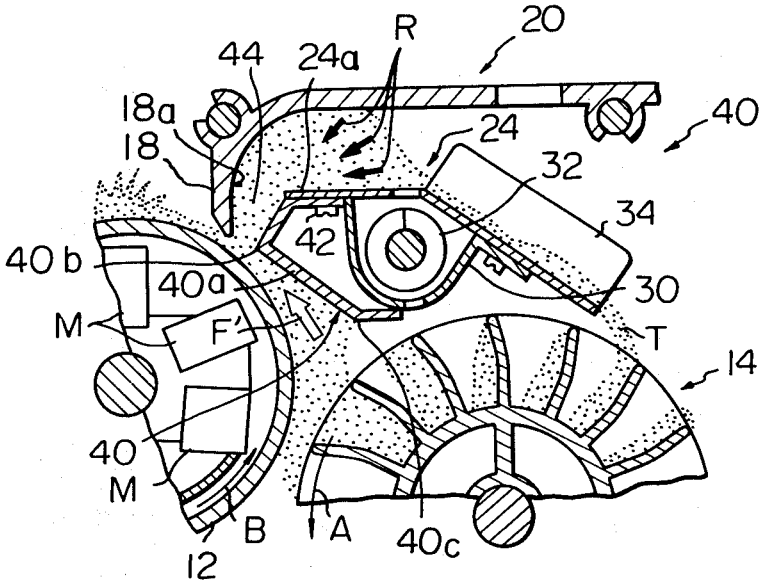
FIG. 2 is a schematic view of a toner recirculating and agitating device embodying the present invention.

Referring to FIG. 2, a toner recirculating and agitating device embodying the present invention is shown and generally designated by the reference numeral 40. As shown, a flow regulating member 40 underlies the horizontal section 24*a* of the toner guide plate 24 at one end thereof and is fastened thereto by screws 42. The flow regulator 40 extends over the axial dimension of the developing sleeve 12. The flow regulator 40 is bent generally downwardly at its position corresponding to the free end of the horizontal section 24*a* so as to define a recirculation path 44 in cooperation with the doctor blade wall 18*a*. This part of the flow regulator 40 connects to a toner guide surface 40*a* which is inclined downwardly to face the developing sleeve 12 at a predetermined spacing therefrom, such that the spacing progressively decreases from the side of the roller 14 toward the side of the doctor blade 18. The toner guide surface 40*a* connects to a horizontal extension (no numeral) the free end of which is engaged with the bottom of the curved casing 30.

In operation, the pressure of the toner T is progressively elevated in between the toner guide surface 40*a* and the sleeve 12 due to the decreasing space therebetween. This develops a larger force F′ for urging the toner T upwardly compared to the force F attained in the prior art device, thereby intensifying the conveying force acting on the toner. The conveyance proceeds with a minimum of loss due to the small angle of friction between the toner guide surface 40*a* and the toner T relative to the angle of friction inside the toner T. Furthermore, because the distance between the flow regulator 40 and the sleeve 12 is shortest at a ridge 40*b* of the flow regulator 40 which neighbors the doctor blade 18, almost all the pressure of the toner T removed by the doctor blade 18 counteracts the resistance R.

The results of some experiments will be described which were carried out to determine the ability of toner coneyance which proceeds in accordance with the movement of the developing sleeve 12.

The toner was conveyed in a desirable manner when one of the magnets M inside the sleeve 12 which faced the toner guide surface 40*a* had a magnetic flux density equivalent to 300–1000 gauss, preferably 400–600 gauss.

When the toner guide surface 40*b* was inclined such that the density of the toner passing through the narrowest space between the toner guide surface 40*a* and the sleeve 12 regulated by the flow regulator 40*b* can be on the order of the bulk density, the decrease in the fatigue of the toner was harmonized with the conveying force necessary for the adequate recirculation of the toner. For the constant amount of toner movement past the doctor blade 18, it was found preferable to supply the toner T from the roller 14 to the sleeve 12 by an amount which is 1.2–3 times the toner amount which moves past the doctor blade 18, more preferably 1.5–2 times in consideration of loads inside the developing apparatus.

Figure 3A:
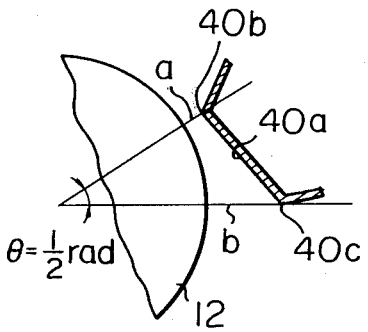
FIGS. 3*a*, 3*b* and 3*c* are diagrams showing different positional relationships between a regulator member of the device shown in FIG. 2 and a developing sleeve.
Figure 3B:
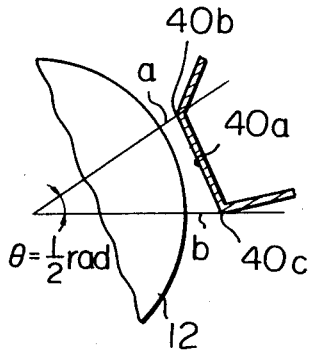
Figure 3C:
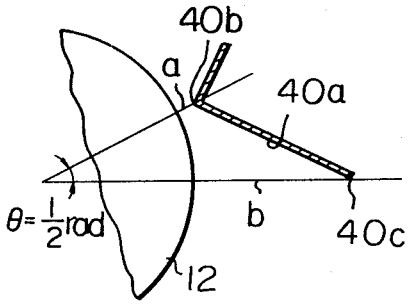

The compression ratio of the toner due to the inherent distance distribution between the toner guide surface 40*a* and the sleeve 12 was determined in terms of $$\frac{\text{distance } (b) \text{ at the remotest position (ridge 40}c)}{\text{distance } (a) \text{ at the nearest position (ridge 40}b)}$$

per radian. Excessively small compression ratios could not offer a sufficient conveying force despite the compression, while excessively large compression ratios stopped the toner flow. Where the toner guide surface 40*a* of the regulator 40 faced the sleeve 12 over the circumferential length of ½ radian as shown in FIG. 3*a*, the toner conveying effect was significant when the ratio b/a was within the range of 2.5–4.5 (5–9 in terms of compression ratio) and not so significant when it was within the range of 1.5–6 (3–12 in terms of compression ratio); the effect was practically zero when $b/a \lesssim 1.5$ as shown in FIG. 3*b* or when $b/a \gtrsim 6$ as shown in FIG. 3*c*.

In summary, it will be seen that the present invention recirculates a developer while effectively agitating it due to a regulator member which develops a pressure to increase the developer conveying force. Particularly, because the developer can be urged upwardly to a substantial level during conveyance, a sufficient height is insured between the raised position of the toner and a toner reservoir so that a room for accommodating another recirculating and agitating device is available in place of or in addition to the device shown and described. This contributes a great deal to the increase in design freedom.

Various modifications will become possible for those skilled in the art after receiving the teachings of the present disclosure without departing from the scope thereof.

What is claimed is:

1. In a developing apparatus including a member for forming a magnet brush of a toner and a toner supply member for supplying the toner to the magnet brush forming member, a toner recirculating and agitating device comprising:

a blade member for controlling the magnet brush on the magnet brush forming member to a predetermined thickness;

means for guiding the toner scraped by said blade member off the magnet brush forming member from the blade member to the toner supply member; and means for intensifying a force which recirculates the toner which is directed toward said guide means;

the guide means comprising a first recirculation path which has an inlet adjacent to and extending upwardly from the blade member and an outlet above the toner supply member, the force intensifying means comprising a second recirculation path which is progressively narrowed as the toner forming the magnet brush approaches the first recirculation path, the second recirculation path being defined by a fixed regulator member.

2. A device as claimed in claim 1, in which the first recirculation path is defined by the blade member, a first toner guide member and a second toner guide member, the regulator member being integral with the second toner guide member and located at a spacing from the magnet brush forming member which progressively decreases toward the blade member.

3. A device as claimed in claim 2, in which the first toner guide member is integral with the blade member.

4. A device as claimed in claim 2, in which the second toner guide member comprises a horizontal section adjacent to the blade member and an inclined section adjacent to the toner supply member.

5. A device as claimed in claim 2, in which a toner compression ratio due to the progressive decrease in the spacing between the magnet brush forming member and the regulator member is given by the ratio of the largest distance b between the regulator member and the magnet brush forming member to the smallest distance a between the regulator member and the magnet brush forming member, the ratio b/a lying within the range of 2.5–4.5.

* * * * *